US006568828B2

(12) United States Patent
Rudoy

(10) Patent No.: US 6,568,828 B2
(45) Date of Patent: May 27, 2003

(54) ILLUMINATING PACKAGING MATERIAL

(76) Inventor: Martin Rudoy, P.O. Box 570604, Tarzana, CA (US) 91357

( * ) Notice: Subject to any disclaimer, the term of this patent is extended or adjusted under 35 U.S.C. 154(b) by 0 days.

(21) Appl. No.: 09/810,300

(22) Filed: Mar. 16, 2001

(65) Prior Publication Data

US 2002/0136004 A1 Sep. 26, 2002

(51) Int. Cl.[7] ..... F21V 33/00; D04D 7/10

(52) U.S. Cl. ..... 362/154; 362/234; 362/253; 362/806; 428/5

(58) Field of Search ..... 40/312, 313; 206/459.1; 428/4, 5; 362/154–156, 234, 253, 806

(56) References Cited

U.S. PATENT DOCUMENTS

| | | | | | |
|---|---|---|---|---|---|
| 3,937,320 | A | * | 2/1976 | Chao et al. | 362/155 |
| 4,283,797 | A | | 8/1981 | Seider | 2/151 |
| 4,363,081 | A | * | 12/1982 | Wilbur | 362/155 |
| 4,422,719 | A | | 12/1983 | Orcutt | 350/96.3 |
| 4,607,747 | A | * | 8/1986 | Steiner | 206/459.1 |
| 4,780,343 | A | | 10/1988 | Coffman | 428/5 |
| 4,895,741 | A | | 1/1990 | Coffman | 428/5 |
| 4,924,362 | A | | 5/1990 | Janko et al. | 362/108 |
| 5,315,492 | A | * | 5/1994 | Davenport | 428/10 |
| 5,521,802 | A | * | 5/1996 | Edington | 362/155 |
| 5,523,741 | A | * | 6/1996 | Cane | 362/154 |
| 5,526,830 | A | | 6/1996 | Hunter | 132/275 |
| 5,693,381 | A | | 12/1997 | Cheng | 428/5 |
| 5,746,500 | A | | 5/1998 | Chien | 362/103 |
| 5,908,232 | A | * | 6/1999 | Burns et al. | 362/156 |
| 5,944,416 | A | | 8/1999 | Marsh | 362/568 |
| 5,980,062 | A | * | 11/1999 | Bell | 362/154 |
| 6,013,346 | A | | 1/2000 | Lewis et al. | 428/78 |
| 6,020,823 | A | | 2/2000 | DeCicco | 340/691.2 |
| 6,059,423 | A | * | 5/2000 | Knopick | 362/156 |
| 6,158,872 | A | * | 12/2000 | Rodgers | 362/156 |
| 6,174,072 | B1 | | 1/2001 | Root, Jr. | 362/190 |
| 6,182,462 | B1 | | 2/2001 | Bania et al. | 62/264 |
| 6,200,000 | B1 | * | 3/2001 | Burnidge | 362/155 |
| 6,296,366 | B1 | * | 10/2001 | Hopps | 362/154 |
| 6,352,355 | B1 | * | 3/2002 | Law | 362/253 |
| 6,405,858 | B1 | * | 6/2002 | Gagliardi | 362/156 |

* cited by examiner

*Primary Examiner*—Alan Cariaso
(74) *Attorney, Agent, or Firm*—Oppenheimer Wolff & Donnelly LLP

(57) ABSTRACT

A packaging for gift wrapping includes a material having a plurality of light-emitting diodes positioned within the material and designed to illuminate when activated. A power supply enables the light-emitting diodes to illuminate when a package upon which the gift wrapping is placed opens or when manually activated. Sound generating devices may also be included to enhance the appeal of the gift wrapping. The packaging may also include LEDs placed inside a gift box to illuminate the contents upon the opening of the gift box.

17 Claims, 3 Drawing Sheets

ILLUMINATING PACKAGING MATERIAL

BACKGROUND OF THE INVENTION

1. Field of the Invention

The present invention provides packaging materials that are capable of illumination. The packaging materials may be in the form of a ribbon, bow, or any other decorative item. The present invention includes a series of LEDs powered by a power supply. The power supply includes a means for turning the power on and a means for activating the LEDs.

2. Description of the Related Art

Prior art techniques for providing illuminated materials or displays exist in many forms. In one prior art technique, a package wrapping for decoratively covering a product container includes shrinkwrappable plastic film and special effects electronics devices, including LEDs. These LEDs can be positioned between the film and the container and held in place by heating or shrinkwrapping. A source of energy powers the LEDs to cause them to illuminate.

Another technique, disclosed in U.S. Pat. No. 5,944,416, provides a decoration apparatus having two flexible sheets adhered to each other with a plurality of light pipes sandwiched in between. This invention provides a decoration that is applicable to different surfaces. Another technique, found in U.S. Pat. No. 6,013,346, provides a display sticker that has an LED circuit and is capable of being adhered to and removed from an article. Still another prior art technique provides LEDs for laces on footwear. LEDs are affixed to a conductive strip, which is then inserted into lace material. The LEDs are used to enhance visibility for wearers of the laces.

Another prior art reference, U.S. Pat. No. 6,174,072, discloses an illuminated ornamental apparatus with a bow having a single LED integrated within it. The LED is illuminated by manually activating a switch external to a housing. The LED is not activated until a person actually closes the switch, or, in the absence of a switch, attaches a battery to the LED. The LED is affixed to the housing and is not an integral part of the bow.

Yet another prior art reference, U.S. Pat. No. 6,182,462, discloses a cooler having an internal light for illuminating the contents of the cooler. The cooler light, which is an incandescent bulb, allows a person opening the cooler to identify the contents. The cooler light is not part of gift wrapping that serves to highlight the contents.

Still another prior art reference, U.S. Pat. No. 5,980,062, discloses LEDs that are attached directly to a box. The reference includes no gift wrapping material that would indicate the LEDs are drawing attention to a gift. The LEDs of this reference are also attached directly to the outside of the box, rather than within a bow or inside a box to highlight the contents.

While the above techniques are useful for decorative placement of lights, they do not provide a technique for placing gift-enhancing illuminating materials on gift packages such as ribbons or bows or as advertising on packaging materials, or on the inside of gift packages. None of the techniques discussed provides materials that illuminate upon the opening of a gift to enhance the experience of gift-giving and receiving. Therefore, there is a need in the art for an assembly of materials that is capable of illuminating upon the opening of a gift or a package which draws attention to the gift and enhances the experience.

INVENTION SUMMARY

The present invention provides packaging materials as part of gift-wrapping that are capable of illuminating. The packaging materials may be illuminated by activating a circuit prior to opening a package upon which the packaging material is placed, or the illumination may be triggered by the opening of the package. The packaging materials, which may include a ribbon, include a series of light-emitting diodes (LEDs) connected to a power supply. The invention provides for illumination when an event is triggered, such as the opening of a package or manual activation of the circuit providing power to the materials. Sound generating devices can also be included, such as computer chips and small speakers, to play certain sounds such as music when a package is opened, in addition to the LEDs or on their own.

One object of the present invention is to provide a wrapping material that is attractive, inexpensive, and simple to use. It is also an object of the invention to provide a wrapping material having lights powered by a power supply, the lights being activated either prior to the opening of a package or as the wrapping material is opened.

It is further an object of the invention to provide a wrapping material which illuminates as it is opened and is also disposable after a single use. Yet another object of the invention is to provide a wrapping material producing sound generated by a power supply, the sound being activated as the wrapping material is opened.

It is a yet another object of the invention to provide a gift box having LEDs embedded inside the box to illuminate the contents of the box. The LEDs may be illuminated either by opening the box or by a manually activating a switch to provide power to the LEDs.

It is still another object of the invention to provide a gift bag having LEDs positioned near a crown of the bag. The bag may include a paper strip positioned inside the bag, with LEDs on the strip protruding through holes in the bag around the crown. Gift boxes may also employ this type of gift wrap assembly such that this object of the invention is not limited to gift bags.

DETAILED DESCRIPTION OF THE EMBODIMENTS

Figures 1, 2, 6:
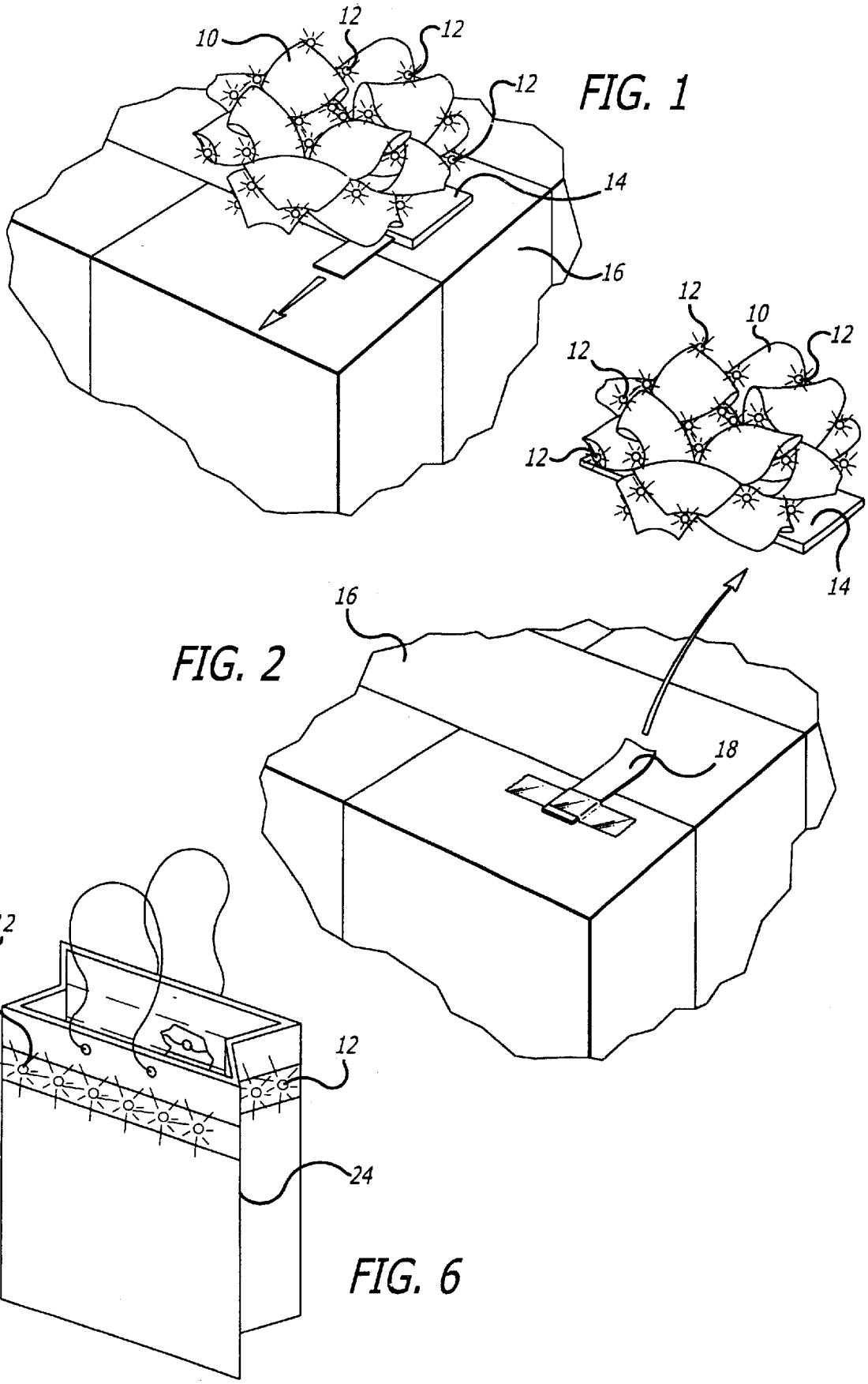
FIG. 1 is a perspective view of the present invention shown on a package. The package is a conventional box having a ribbon and a housing placed on top, with the ribbon including a plurality of LEDs intertwined between the pieces of material forming the ribbon.
FIG. 2 is a perspective view of the package having the ribbon containing the LEDs, with the ribbon and housing separated to show the presence of a strip used to actuate the LEDs by closing a circuit to provide power to the LEDs.
FIG. 6 is a perspective view of a gift bag having LEDs positioned therein.

Referring to FIG. 1, the packaging material includes a ribbon 10, which may be made of nylon, cloth, or other conventional material commonly used to make ribbons. The ribbon 10 in one embodiment is about ½ inch wide. The ribbon 10 has lights that are coupled to the ribbon. The lights include a series of LEDs 12 that may be either white or red. In one embodiment, the LEDs may be configured to either flash or illuminated steadily, as desired by the user. The LEDs 12 are standard light-emitting diodes. In another embodiment, the lights used in the present invention are incandescent light bulbs. In another embodiment, the lights are light bulbs encased with plastic.

The LEDs 12 may be coupled to the ribbon by threading the leads to the LEDs through the ribbon material so that they pass through gaps between ribbon pieces or protrude through openings between ribbon pieces. For example, the leads of the LEDs, which are coupled on one end to a circuit for powering the LEDs, are positioned to pass up through the ribbon from the circuit and protrude through openings between the ribbon material. The LEDs may also be attached to the ribbon by fastening the leads of the LEDs to the back of the material or by otherwise concealing the leads within the ribbon material. In one embodiment of the invention, the ribbon includes a series of LEDs intertwined within the ribbon. In another embodiment, the ribbon is curled with a channel passing through its center. The leads of the LEDs are connected with the material such the LEDs snake through the curled ribbon in the channels formed therein.

The ribbon 10, which may be in the form of a bow, is attached to a housing 14 containing a circuit to provide power to the LEDs. The housing 14 contains a battery, a series of leads corresponding to the LEDs, and a switch for closing the circuit between the battery and LEDs. The housing is placed at the base of the ribbon 10 and adheres to the package 16 upon which the ribbon is placed, either on top or concealed within the package. The package 16 may be a gift box, a gift bag, or any other container in which items may be packaged. In one embodiment, the housing includes an adhesive substance on one side that is used to adhere the housing to the package. When the housing is placed at the base of the ribbon material, it also provides support for the ribbon material atop the package upon which it is placed. The housing itself may be made of plastic or any other material commonly used to house electrical components for widespread commercial use.

In one embodiment, the LEDs are incorporated into the ribbon material such that at least some of the LEDs are actually embedded within the material itself. Other LEDs may be included that are not embedded within the ribbon.

In another embodiment, a gift bag is provided having LEDs 12 positioned near a crown of the bag. The bag may include a paper strip positioned inside the bag, with LEDs coupled to the strip and protruding through holes in the bag around the crown. The gift bag includes a housing having the power supply for the LEDs 12, the housing being positioned inside the bag. Gift boxes may also employ this type of gift wrap assembly. The power supply may be configured to trigger illumination of the LEDs automatically upon opening or manually by closing the switch in the power supply.

In another embodiment, sound-generating devices may also be included, such as computer chips and small speakers, to play certain sounds when activated. The sound-generating devices are powered by the power supply, and may be included in addition to the LEDs or on their own. Also, the sound-generating devices may be positioned within the ribbon material in an intertwined manner, in an embedded manner, or within the housing.

FIG. 2 is a perspective view of the present invention showing the ribbon 10 and the housing 14 separated from the package 16. Also shown in FIG. 2 is a strip 18 which is in the housing 14, with an end of the strip 18 slightly protruding from the housing 14. The strip is used to actuate the LEDs by closing the circuit in the housing and powering the LEDs.

The LEDs are powered by a switch which remains open until a person either closes the switch manually or opens the package upon which the LEDs are placed. The ribbon may be connected to a strip which is pulled out of the housing either as the ribbon is pulled or by manually pulling the strip by hand. In either case, the pulling of the strip closes the circuit in the housing, allowing power to flow from the battery to the leads of the LEDs. Thus, the present invention can be used to illuminate a gift prior to being opened, or to illuminate upon opening.

In one embodiment, the strip is not replaceable back into the housing. Accordingly, the LEDs will continue to be lighted by the battery until the LEDs are disconnected or the battery loses the ability to power them. Thus, the invention is meant to be disposable and used only one time. The ribbon and the LEDs can therefore be disposed of when no longer needed.

In an alternate embodiment, the strip is replaceable such that the circuit and the ribbon are reuseable. Thus, the switch in the circuit can be opened or closed manually in and on/off fashion. In this embodiment, the functioning of the LEDs are controllable to turn them on or off depending on the needs of the persons using the ribbon material having the LEDs.

Figure 3:
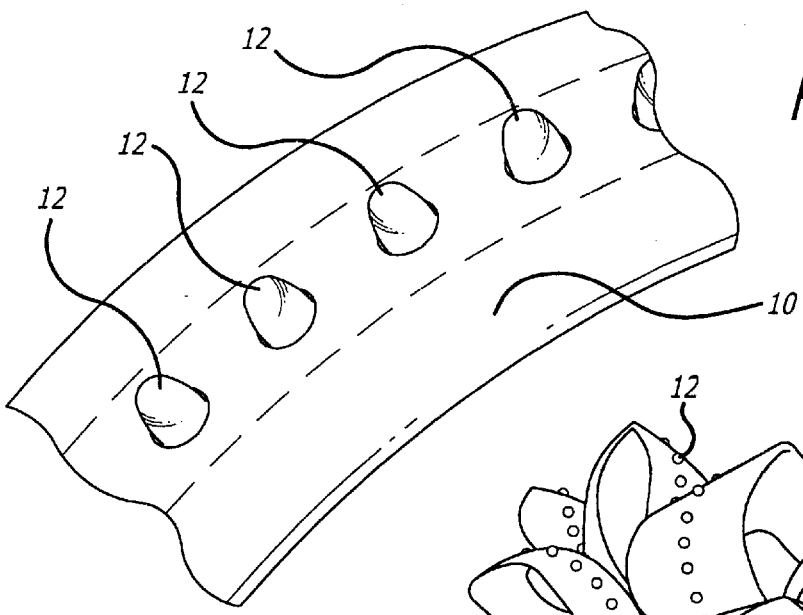
FIG. 3 is a close-up view of a piece of ribbon forming material having a series of LEDs placed therein.
Figure 4:
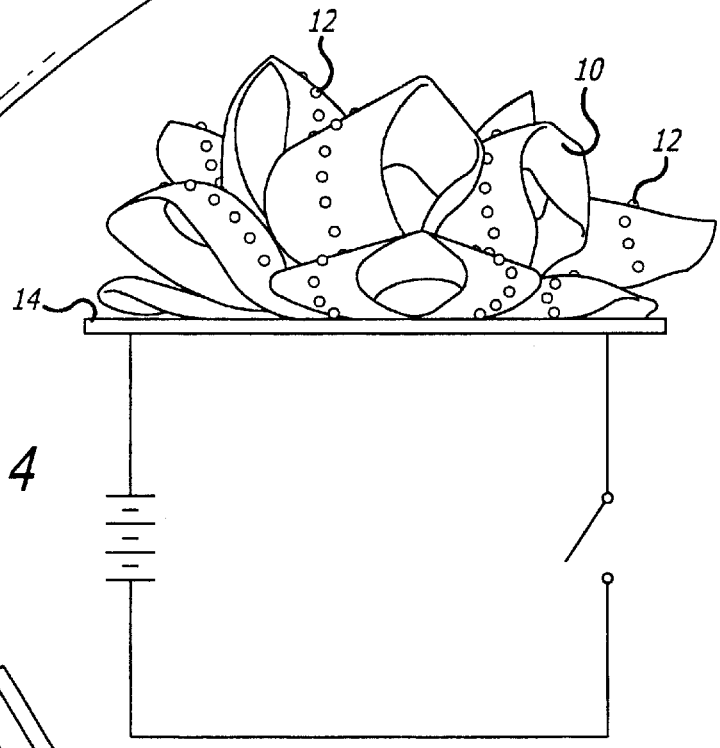
FIG. 4 shows a side view of the packaging material with LEDs placed within the material and the housing, and also showing a circuit diagram beneath the material and housing indicating an open circuit.

FIG. 3 is a close-up view of a piece of ribbon forming material having a series of LEDs placed therein. In this embodiment, LEDs are embedded within the ribbon 10 and protrude through the fabric of the material. FIG. 4 shows a side view of the packaging material with LEDs placed within the fabric of the material of the ribbon 10. FIG. 4 also shows the housing 14 and a circuit diagram beneath the ribbon 10 and housing 14 indicating an open circuit. In this configuration, the circuit would not provide power to LEDs until the circuit is closed.

In yet another embodiment, the ribbon also includes displays which light up to spell words or phrases when the power is supplied. The displays may be either intertwined within the ribbon materials, or embedded into the ribbon material itself.

Figure 5:
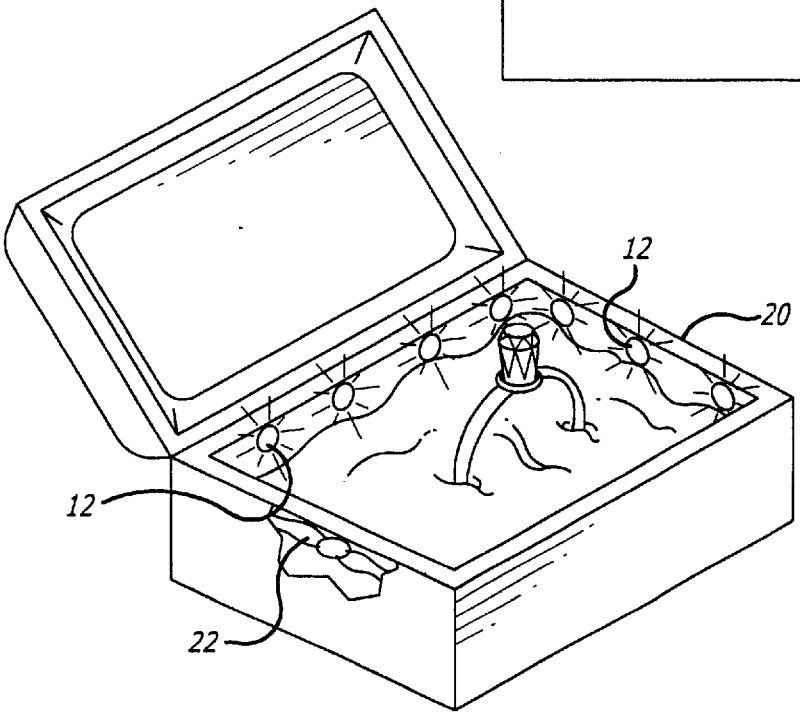
FIG. 5 is a perspective view of a gift box having an open lid and LEDs positioned inside the box along the side of the edges to illuminate an item placed inside the box.

FIG. 5 is a perspective view of a box 20 in which a series of LEDs 12 are positioned within the box to illuminate items placed inside the box. In one embodiment, the LEDs are positioned along the edges of the box 20 such that they are hidden from view when looking directly at the top of the open box 20. The LEDs are positioned along the inside part of the edges and are configured to illuminate once the box 20 is opened. The opening of the box 20 closes a switch positioned inside the box underneath an item placed in the box and activates the LEDs 12, thereby illuminating the interior of the box. Similarly, the closing of the box 20 opens the switch positioned inside the box and deactivates the LEDs 12. The LEDs have leads 22 and a battery attached to said leads 22, which are all contained within the box 20 underneath any items placed in the box that are intended to be illuminated. The box 20 may also include a sound generating device for playing a sound when the switch is closed. The sound generating device may be positioned within the box 20 and, similar to the LEDs, is activated by the opening of the box 20.

Another embodiment of the present invention is shown in FIG. 6. A gift bag 24 has a plurality of LEDs 12 positioned across an upper portion, or crown, of the gift bag 24. The LEDs 12 are positioned to illuminate through a series of holes in the upper portion of the gift bag 24. The leads of the LEDs 12 remain inside the gift bag 24. An applicator holds the LEDs and leads in place within the gift bag 24. A power supply for providing power to the LEDs 12 is also included within the gift bag 24. The gift bag 24 may include sound generating devices. The LEDs on the gift bag 24 may be illuminated by a switch which closes a circuit in the power supply to provide power to the LEDs.

Figure 7:
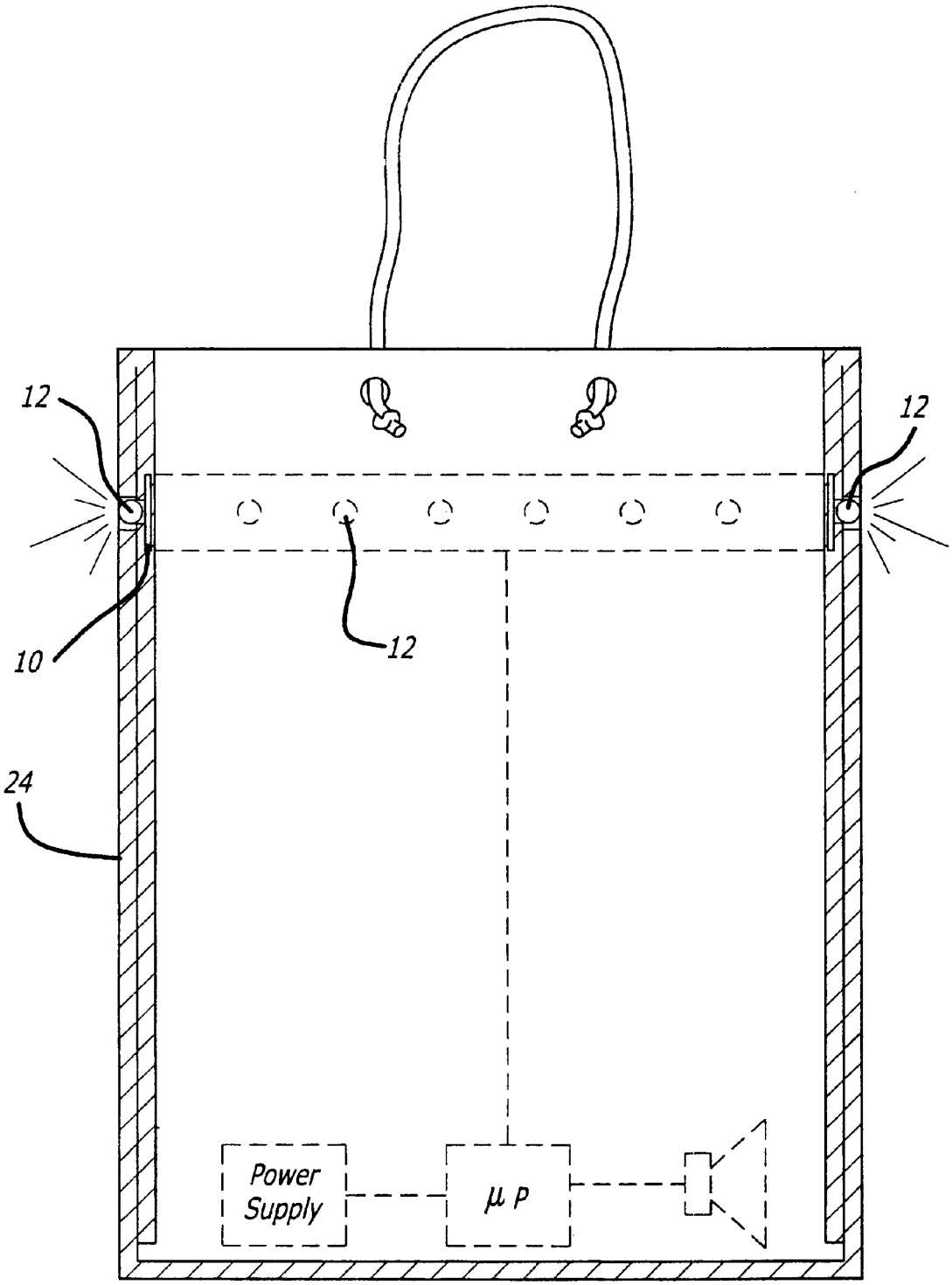
FIG. 7 is a view of a gift bag with broken lines showing the inside of the bag and components therein.

FIG. 7 is a side view of a gift bag showing interior contents of the bag with broken lines. FIG. 7 shows an applicator as described above. FIG. 7 also shows a sound-generating device positioned within the bag. The sound-generating device may include a speaker. A computer chip, or microprocessor, may be used to drive the speaker to enable the sound-generating device to produce sound. Also shown inside the bag is a power supply.

The application of LEDs to packaging material has many applications beyond their use with ribbon material. For example, the LEDs may be applied to the tops of boxes without ribbons to illuminate upon the opening of the box. LEDs may also placed on bottles or other materials in the form of advertisements. LEDs may also be embedded in packages such as boxes or bottles to be illuminated and highlight particular words or phrases in advertising or product packaging.

We claim:

1. A gift wrap assembly comprising:

a material forming a ribbon, the ribbon having a plurality of light-emitting diodes positioned in said material such that the plurality of light-emitting diodes are intertwined with the material and outwardly protruding at various places from the ribbon;

a power supply electrically connected to the light-emitting diodes; and a housing attached to the material, the power supply situated within said using.

2. The gift wrap assembly of claim 1, further comprising at least one sound-generating device, the power supply electrically connecting to the sound-generating device to provide power to said sound-generating device.

3. The gift wrap assembly of claim 1, wherein the material is a ribbon placed on a box.

4. The gift wrap assembly of claim 1, further comprising a strip removably disposed within said housing, the strip being removable to close a circuit allowing the power supply to illuminate said light-emitting diodes.

5. A packaging material capable of illumination, said material comprising:

a plurality of light-emitting diodes positioned within a material forming a ribbon such that the plurality of light-emitting diodes are intertwined with the material and outwardly protruding at various places from the ribbon; and a power supply situated in a housing coupled to the material forming said ribbon, said power supply being electrically connected to said light-emitting diodes.

6. The packaging material of claim 5, further comprising a strip removably disposed within said housing, the strip being removable to close a circuit allowing the power supply to illuminate said light-emitting diodes.

7. The packaging material of claim 5, further comprising at least one sound-generating device, the power supply electrically connecting to the sound-generating device to actuate sound from said sound-generating device.

8. The packaging assembly of claim 5, wherein said material forming said ribbon is coupled to a package.

9. The packaging assembly of claim 8, wherein the housing is removably affixed to said package.

10. The packaging assembly of claim 9, further comprising a strip removably disposed within said housing, the strip being removable to close a circuit allowing the power supply to illuminate said light-emitting diodes.

11. A method of providing a packaging assembly capable of illumination, comprising:

placing a plurality of light-emitting diodes within a ribbon-forming material such that the plurality of light-emitting diodes are intertwined with the ribbon-forming material and outwardly protruding at various places; and providing a power supply to illuminate said light-emitting diodes.

12. The method of claim 11, further comprising placing said plurality of light-emitting diodes and said ribbon-forming material on a package.

13. The method of claim 11, further comprising placing said power supply within a housing, the housing being coupled to the ribbon-forming material and affixed to a package.

14. The method of claim 13, further comprising positioning a strip removably disposed within said housing, the strip being removable to close a circuit allowing the power supply to illuminate said light-emitting diodes.

15. The method of claim 11, further comprising at least one sound-generating device, the power supply electrically connecting to the sound-generating device to actuate sound from said sound-generating device.

16. The method of claim 13, further comprising at least one sound-generating device disposed within said housing, the power supply electrically connecting to the sound-generating device to actuate sound from said sound-generating device.

17. An illuminating gift box assembly comprising:

a box having a plurality of light-emitting diodes positioned therein along at least one edge on an inside of said box, wherein the plurality of light-emitting diodes are also positioned to protrude from the inside of the box to illuminate a contents of the box;

a power supply electrically connected to said light-emitting diodes, said power supply being positioned within said inside of said box;

a switch positioned within said box, the switch being configured to activate the plurality of light-emitting diodes when said box is opened and to deactivate the plurality of light-emitting diodes when said box is closed; and a sound generating device positioned within said box and configured to play a sound when said box is opened.

* * * * *